US011198571B2

(12) United States Patent
Ota

(10) Patent No.: US 11,198,571 B2
(45) Date of Patent: Dec. 14, 2021

(54) IMAGE FORMING APPARATUS

(71) Applicant: CANON KABUSHIKI KAISHA, Tokyo (JP)

(72) Inventor: Sho Ota, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 16/450,663

(22) Filed: Jun. 24, 2019

(65) Prior Publication Data

US 2019/0389678 A1 Dec. 26, 2019

(30) Foreign Application Priority Data

Jun. 26, 2018 (JP) ..... JP2018-121325

(51) Int. Cl.

| | |
|---|---|
| ***B65H 3/06*** | (2006.01) |
| ***B65H 1/14*** | (2006.01) |
| ***B65H 7/04*** | (2006.01) |
| ***B65H 1/08*** | (2006.01) |
| ***B65H 1/26*** | (2006.01) |

(52) U.S. Cl.

CPC ..... *B65H 3/0684* (2013.01); *B65H 1/08* (2013.01); *B65H 1/14* (2013.01); *B65H 1/266* (2013.01); *B65H 7/04* (2013.01); *B65H 2405/31* (2013.01); *B65H 2511/515* (2013.01); *B65H 2511/52* (2013.01); *B65H 2551/20* (2013.01); *B65H 2553/412* (2013.01); *B65H 2553/612* (2013.01)

(58) Field of Classification Search

CPC .. B65H 3/0684; B65H 1/14; B65H 2553/612; B65H 2553/52; B65H 2551/20; B65H 2511/515; B65H 2405/31

See application file for complete search history.

(56) References Cited

U.S. PATENT DOCUMENTS

| | | | | |
|---|---|---|---|---|
| 9,181,055 | B2 * | 11/2015 | Kosaka | B65H 7/20 |
| 9,383,708 | B1 * | 7/2016 | Imaizumi | G03G 15/70 |
| 9,975,717 | B2 * | 5/2018 | Fujinuma | B65H 7/04 |
| 2020/0361733 | A1 * | 11/2020 | Mochizuki | B65H 5/06 |

FOREIGN PATENT DOCUMENTS

JP 2015-086048 A 5/2015

* cited by examiner

*Primary Examiner* — Patrick Cicchino
(74) *Attorney, Agent, or Firm* — Canon U.S.A., Inc. I.P. Division

(57) ABSTRACT

An image forming apparatus includes a control unit and an attachment detection unit to detect attachment of a cassette having a stacking portion that may be lifted by a motor. The control unit drives the motor to start lifting the stacking portion when cassette attachment is detected and stops when the stacked uppermost sheet is detected at a sheet feed position, at which time the presence or absence of the stored sheet is determined based on a detection signal output by a sheet presence/absence detection unit. In a case where there is no change in the detection signal output from the sheet presence/absence detection unit when the attachment of the cassette is detected, the control unit determines that a failure of the sheet presence/absence detection flag occurred.

15 Claims, 12 Drawing Sheets

FIG.6A1
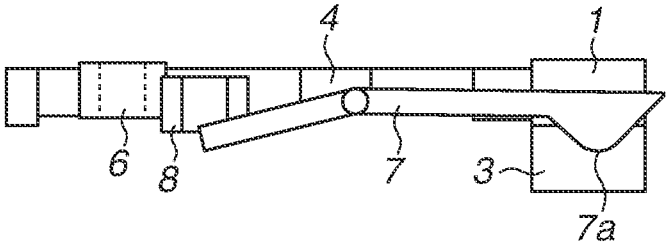
FIG.6A2
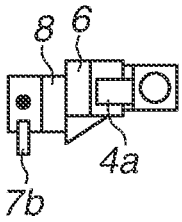
FIG.6B1
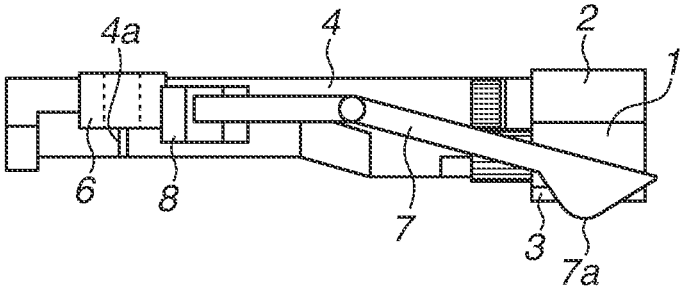
FIG.6B2
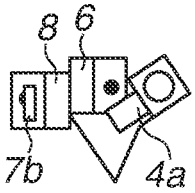
FIG.6C1
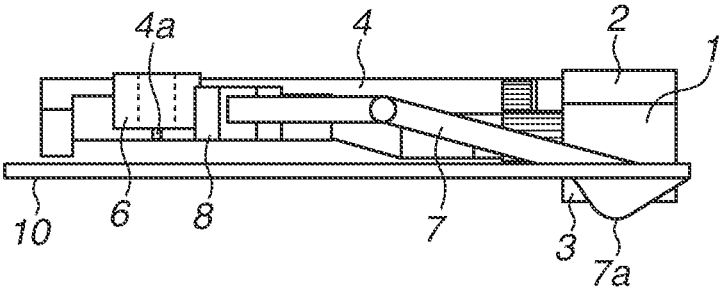
FIG.6C2
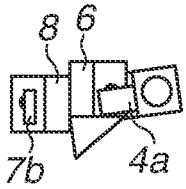
FIG.6D1
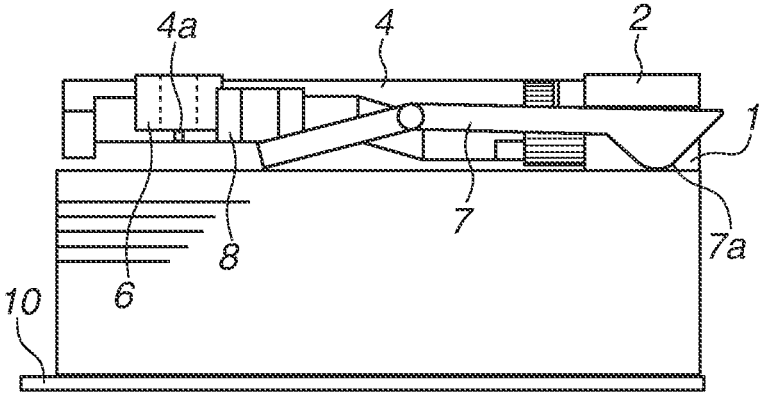
FIG.6D2
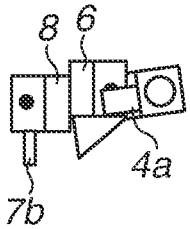

FIG.7A1
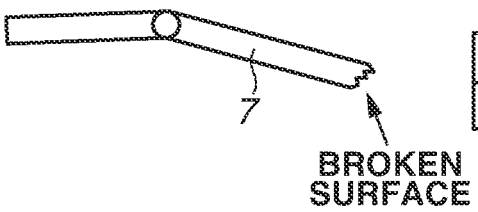
FIG.7A2
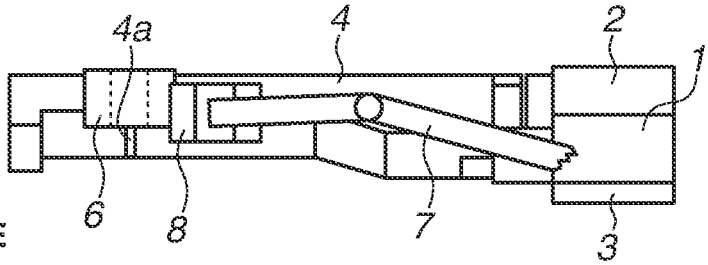
FIG.7B1
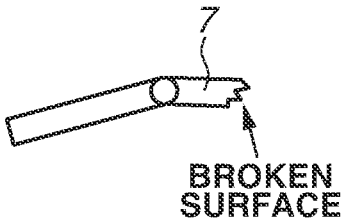
FIG.7B2
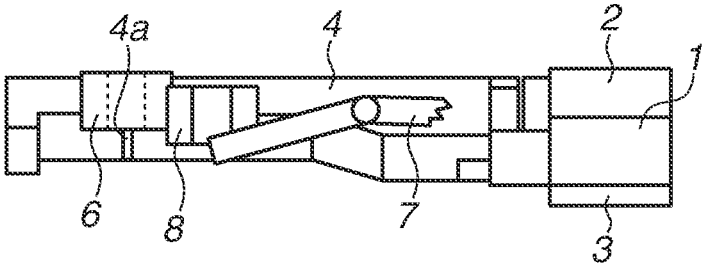

IMAGE FORMING APPARATUS

BACKGROUND OF THE INVENTION

Field

The present disclosure relates to an image forming apparatus including a feeding device that feeds sheets.

Description of the Related Art

Conventionally, an image forming apparatus such as a copy machine or a printer includes a feeding device for feeding sheets to an image forming unit. The feeding device includes a cassette serving as a sheet storage portion drawably attached to an apparatus main body, and a feeding unit that feeds the sheets stored in the cassette. The feeding device also includes a sheet presence/absence detection unit for detecting presence or absence of the sheets in the cassette.

The sheet presence/absence detection unit generally includes a sheet presence/absence detection flag and a photosensor. The sheet presence/absence detection flag is swingably and pivotally supported by the apparatus main body, and when a sheet stacked in a stacking portion on which the sheets are stacked comes in contact with one end of the flag, the other end changes a light-shield state of the photosensor. With this arrangement, the presence or absence of the sheets is detected.

Japanese Patent Application Laid-Open No. 2015-086048 proposes a configuration for determining whether a failure has occurred to a sensor in the sheet presence/absence detection unit.

Incidentally, when the cassette is drawn out of or attached to the apparatus main body, the sheet presence/absence detection flag in the sheet presence/absence detection unit may be detached or broken due to a collision between the flag and the cassette, the sheet, or the like. In Japanese Patent Application Laid-Open No. 2015-086048, although a failure of the sensor in the sheet presence/absence detection unit is detected, a failure of the flag is not detected.

When a failure of the sheet presence/absence detection flag occurs, it may be erroneously detected that a sheet is absent when the sheet is actually present or that a sheet is present when the sheet is actually absent. In the former case, a feeding error occurs when the feeding device tries to start feeding. In the latter case, feeding is not started.

SUMMARY OF THE INVENTION

The present disclosure is directed to detecting a failure of a sheet presence/absence detection flag.

According to an aspect of the present disclosure, an image forming apparatus includes a cassette drawably attached to an apparatus main body and configured to store a sheet, an attachment detection unit configured to detect attachment of the cassette, a stacking portion provided in the cassette and on which the sheet is to be stacked, a motor configured to lift the stacking portion, a feeding roller configured to feed the sheet stacked on the stacking portion, an image forming unit configured to form an image on the sheet fed by the feeding roller, a sheet surface detection unit configured to detect that an uppermost sheet stacked on the stacking portion is at a sheet feed position, a sheet presence/absence detection unit configured to detect presence or absence of the sheet stacked on the stacking portion, wherein the sheet presence/absence detection unit includes a sheet presence/absence detection flag provided in the apparatus main body and is configured to turn in association with the attachment of the cassette, and a control unit configured to drive the motor to start lifting the stacking portion when the attachment of the cassette is detected by the attachment detection unit, to stop lifting the stacking portion in a case where the sheet surface detection unit detects that the uppermost sheet stacked on the stacking portion is at the sheet feed position and, after lifting the stacking portion is stopped, to determine presence or absence of the sheet stored in the cassette based on a detection signal output from the sheet presence/absence detection unit, wherein, in a case where there is no change in the detection signal output from the sheet presence/absence detection unit when the attachment of the cassette is detected by the attachment detection unit, the control unit determines that a failure of the sheet presence/absence detection flag occurred.

Further features of the present disclosure will become apparent from the following description of exemplary embodiments with reference to the attached drawings.

BRIEF DESCRIPTION OF THE DRAWINGS

FIGS. 6A1 to 6D2 are diagrams illustrating operation of a sheet sensor and a sheet surface sensor in a sheet presence/absence detection unit.

FIGS. 7A1 to 7B2 are diagrams illustrating a failure mode of a sheet presence/absence detection flag.

DESCRIPTION OF THE EMBODIMENTS

Figure 1:
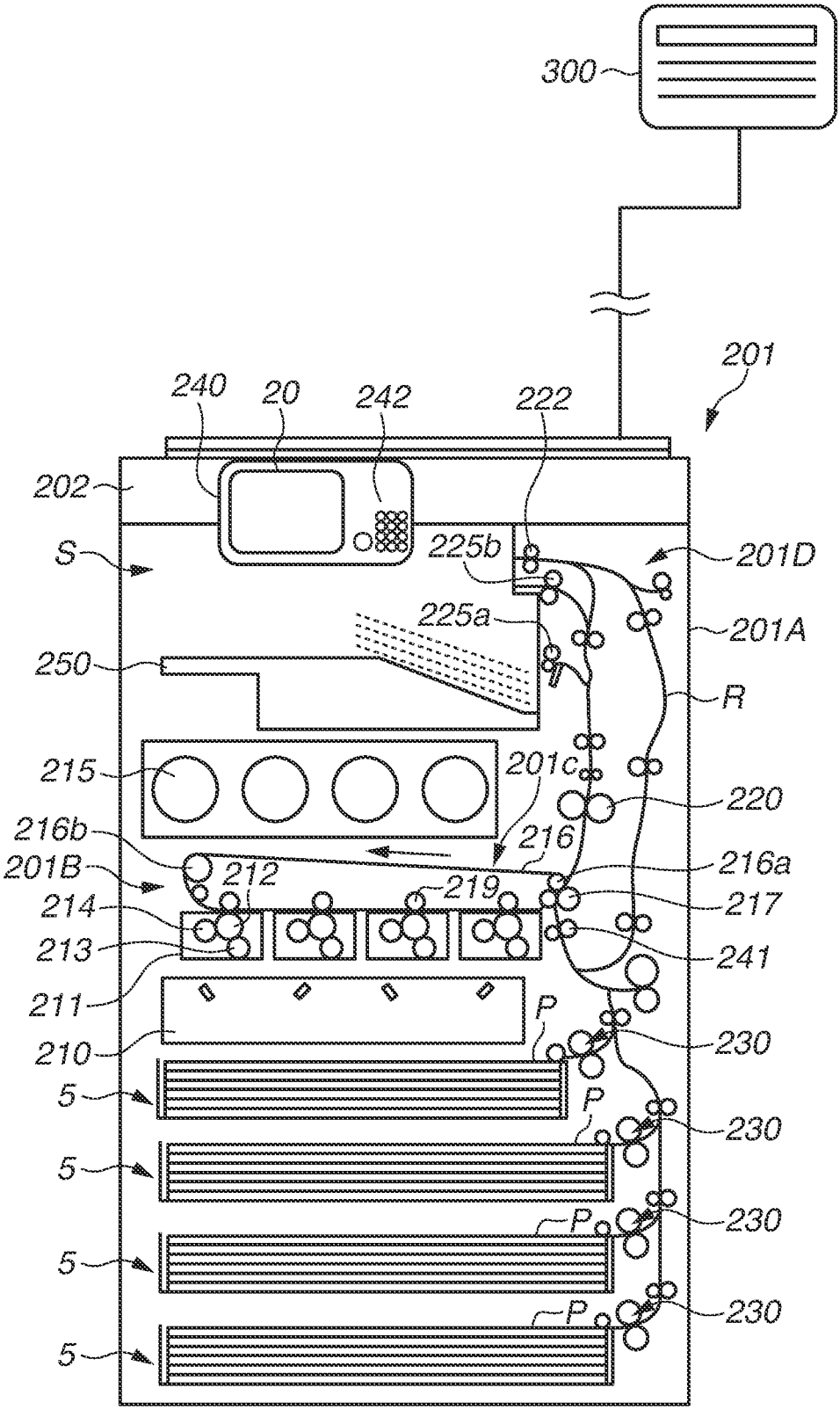
FIG. 1 is a diagram schematically illustrating a configuration of an image forming apparatus.

Hereinafter, exemplary embodiments of the present disclosure will be described with reference to the drawings. FIG. 1 is a diagram schematically illustrating a configuration of an image forming apparatus including a feeding device.

In FIG. 1, an image forming apparatus 201 includes an apparatus main body 201A and an image forming unit 201B that forms an image on a sheet. In the image forming apparatus 201, a sheet discharge space S for sheet discharge is formed between an image reading device 202 and the apparatus main body 201A.

The image forming unit 201B employs a four-drum full color system, and includes a laser scanner 210 and four process cartridges 211 which form toner images with four colors of yellow (Y), magenta (M), cyan (C), and black (K). Each of the process cartridges 211 includes a photosensitive drum 212, a charger 213, and a developer unit 214. The image forming unit 201B also includes an intermediate transfer unit 201C and a fixing portion 220 disposed above the process cartridges 211. Toner cartridges 215 supply toner to the developer units 214.

The intermediate transfer unit 201C includes an intermediate transfer belt 216 stretched around a drive roller 216*a* and a tension roller 216*b*. Primary transfer rollers 219 are provided inside the intermediate transfer belt 216 so as to be in contact with the intermediate transfer belt 216 at positions facing the respective photosensitive drums 212. The intermediate transfer belt 216 is rotated in a direction indicated by an arrow by the drive roller 216*a* to be driven by a drive portion (not illustrated).

The toner images of the colors having a negative polarity on the photosensitive drums 212 are sequentially transferred onto the intermediate transfer belt 216 by the primary transfer rollers 219. At a position opposite to the drive roller 216*a* in the intermediate transfer unit 201C, a secondary transfer roller 217 that transfers the color images formed on the intermediate transfer belt 216 onto a sheet P is disposed. The fixing portion 220 is disposed above the secondary transfer roller 217 and, at an upper left portion of the fixing portion 220, a first discharge roller pair 225*a*, a second discharge roller pair 225*b*, and a two-sided reversing unit 201D are disposed. In the two-sided reversing unit 201D, there are provided a reverse roller pair 222 which can be freely rotated forward or backward without meaningful restriction, a re-conveying path R on which the sheet having the image on one side thereof is conveyed to the image forming unit 201B again, and the like.

Feeding devices 230 that feed the sheets to the image forming unit are provided to a lower portion of the apparatus main body 201A.

Next, an image forming operation of the image forming apparatus 201 will be described. First, the image reading device 202 reads image information on a document. Then, the image information is subjected to image processing is subsequently converted into an electric signal, and is transmitted to the laser scanner 210 in the image forming unit 201B. In the image forming unit 201B, a surface of the photosensitive drum 212 that is uniformly and electrostatically charged to a predetermined polarity and a predetermined potential by the charger 213 is sequentially exposed to laser beams. Thus, electrostatic latent images of yellow, magenta, cyan, and black are sequentially formed on the photosensitive drums 212 of the process cartridges 211, respectively.

Subsequently, the electrostatic latent images are developed with toners of the colors to be visualized. Further, the toner images of the colors formed on the photosensitive drums 212 are sequentially superimposed and transferred onto the intermediate transfer belt 216 by a primary transfer bias applied to the primary transfer rollers 219. As a consequence, the toner images are formed on the intermediate transfer belt 216.

Meanwhile, the sheet P fed from the feeding device 230 is conveyed to a registration roller 241, and skew feeding is corrected by the registration roller 241.

After the skew feeding is corrected, the sheet P is conveyed to a secondary transfer portion by the registration roller 241. Subsequently, the toner images are transferred onto the sheet P by a secondary transfer bias that is applied to the secondary transfer roller 217 in the secondary transfer portion. The sheet P on which the toner images are transferred is conveyed to the fixing portion 220. In the fixing portion 220, the sheet P receives heat and pressure, whereby the toners of the colors are fused and mixed so that color images are fixed onto the sheet P.

The sheet P on which the images are fixed is discharged to the sheet discharge space S by the first discharge roller pair 225*a* and the second discharge roller pair 225*b* disposed downstream of the fixing portion 220, and then, is stacked on a stacking portion 223 disposed in such a manner as to project at a bottom surface of the sheet discharge space S. In a case where the images are formed on both sides of the sheet P, the sheet P on which the images are fixed is conveyed to the re-conveying path R by the reverse roller pair 222, and then, is conveyed again to the image forming unit 201B.

The image forming apparatus 201 is a user interface for displaying information and accepting an instruction from a user via an operation screen 20. In addition, the image forming apparatus 201 includes a network interface that allows transmission and receiving of data to and from a server 300 serving as an external apparatus via an Internet network or the like.

<Configuration of Feeding Device>

A configuration of the feeding device 230 will be described with reference to FIGS. 2 to 4C.

<Configuration of Cassette Attachment Detection>

First, a configuration of attachment detection of a cassette 5 will be described. The apparatus main body 201A includes a cassette attachment sensor 9 as an attachment detection unit that detects attachment of the cassette 5. The cassette 5 includes an attachment detection flag 5*a* that shields the cassette attachment sensor 9 from light. When the cassette 5 is attached to the apparatus main body 201A, the attachment detection flag 5*a* shields the cassette attachment sensor 9 from light. When the attachment detection flag 5*a* shields the cassette attachment sensor 9 from light, a detection signal output from the cassette attachment sensor 9 changes, and a control unit 260 determines that the cassette 5 is attached to the apparatus main body 201A.

The cassette 5 includes an intermediate plate 10 serving as a stacking portion on which the sheets are stacked, and a tray 11 that pushes up the intermediate plate 10. The intermediate plate 10 and the tray 11 are each turnably supported on a shaft provided in the cassette 5. The tray 11 is driven by a lifter motor M2. The intermediate plate 10 is provided with a hole 10*a* used for detecting presence or absence of the sheets.

Figure 3:
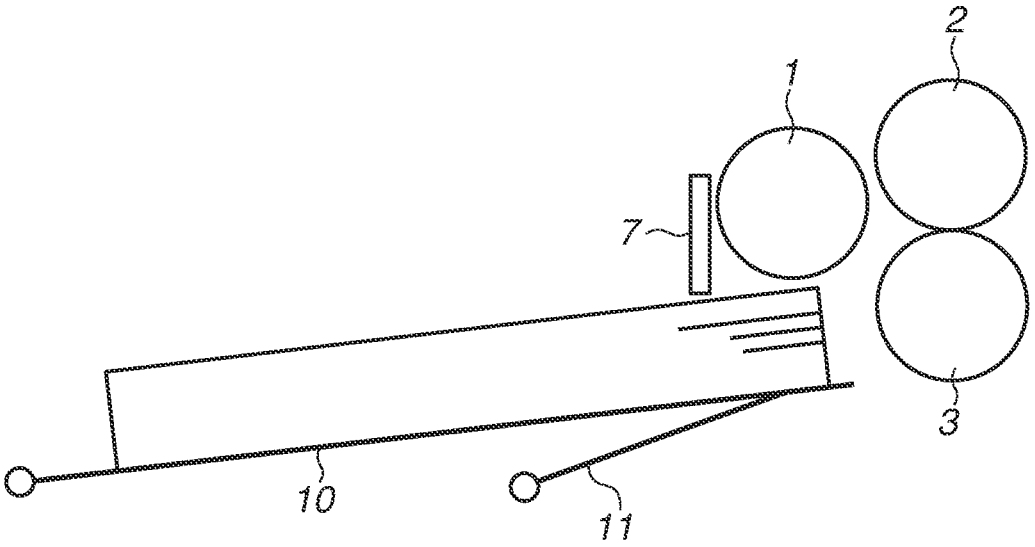
FIG. 3 is a diagram illustrating a configuration of periphery of the cassette.
Figure 4A:
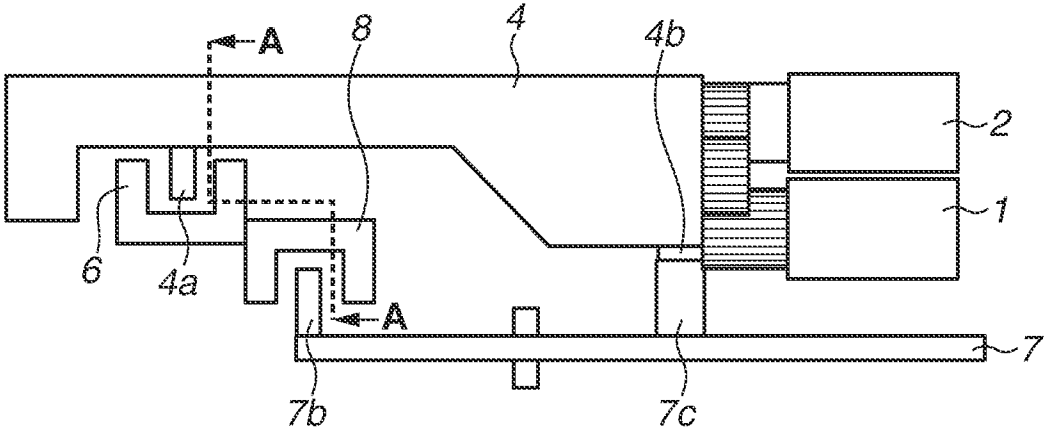
FIGS. 4A to 4C are diagrams schematically illustrating configurations of a feeding device.
Figure 4B:
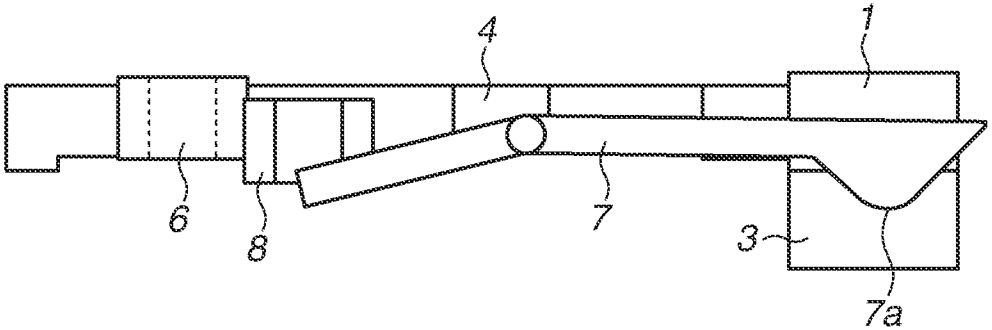
Figure 4C:
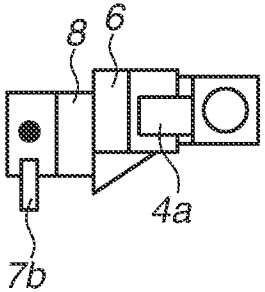

As illustrated in FIGS. 3 to 4C, the feeding device 230 includes a pickup roller 1 that picks up the sheets on the intermediate plate 10. The pickup roller 1 is an example of a feeding roller. The feeding device 230 also includes a feeding roller 2 that feeds the sheet picked up by the pickup roller 1 to the image forming unit, and a retard roller 3 that is pressed by the feeding roller 2 and returns the second and subsequent sheets. Each roller is rotated by being driven by a feeding motor M1. The pickup roller 1 is pressed downward by a spring (not illustrated), and is held by a pick holder 4 rotatably and pivotally supported about the feeding roller 2. When the cassette 5 is drawn out, the pick holder 4 is retracted to a position (retracted position) away from the intermediate plate 10 by a retracting mechanism (not illustrated) that operates in association with attachment and drawing out of the cassette 5.

<Configuration of Sheets Height Detection>

Next, a configuration of sheets height detection will be described. As illustrated in FIGS. 4A to 4C, the pick holder 4 includes a flag portion 4*a*, and detects a sheets height by shielding, by the flag portion 4*a*, a sheet surface sensor 6 serving as a photosensor from light. The sheet surface sensor 6 is an example of a sheet surface detection unit. The sheets height to be detected is a sheets height at a sheet feed position, which is an appropriate height for feeding the sheets. In the present exemplary embodiment, a state where the flag portion 4*a* shields the sheet surface sensor 6 from light is referred to as "ON state of the sheet surface sensor 6 (the sheets height is appropriate)", and a state where the flag portion 4*a* does not shield the sheet surface sensor 6 from light is referred to as "OFF state of the sheet surface sensor 6 (the sheets height is low)".

<Configuration of Sheet Presence/Absence Detection>

A configuration of sheet presence/absence detection of the feeding device 230 will be described. A sheet presence/absence detection flag 7 and a sheet sensor 8 serving as a photosensor are attached to a feed frame (not illustrated). The sheet presence/absence detection flag 7 is turnably and pivotally supported by the feed frame, and presence or absence of the sheets can be detected by shielding the sheet sensor 8 from light by the sheet presence/absence detection flag 7. In the present exemplary embodiment, a state where the sheet presence/absence detection flag 7 shields the sheet sensor 8 from light is referred to as "ON state of the sheet sensor 8 (sheet is absent)", and a state where the sheet presence/absence detection flag 7 does not shield the sheet sensor 8 from light is referred to as "OFF state of the sheet sensor 8 (sheet is present)". One end of the sheet presence/absence detection flag 7 is a sheet abutment portion 7*a* that abuts on the sheet, and the other end is a light-shielding portion 7*b* that shields the sheet sensor 8 from light. A balance of the weight of the sheet presence/absence detection flag 7 is configured so that a side of the sheet abutment portion 7*a* is heavier. The sheet presence/absence detection flag 7 is provided with a holder abutment portion 7*c* that abuts on an abutment portion 4*b* of the pick holder 4.

If the cassette 5 is drawn out of the apparatus main body 201A and the pick holder 4 is turned to the retracted position by the retracting mechanism, the abutment portion 4*b* of the pick holder 4 abuts on the holder abutment portion 7*c* of the sheet presence/absence detection flag 7. With this arrangement, the side of the sheet abutment portion 7*a* of the sheet presence/absence detection flag 7 is lifted, and a side of the light-shielding portion 7*b* of the sheet presence/absence detection flag 7 hangs down. When the light-shielding portion 7*b* of the sheet presence/absence detection flag 7 hangs down, the sheet sensor 8 changes from the ON state to the OFF state. More specifically, by the cassette 5 being drawn out of the apparatus main body 201A, the sheet sensor 8 changes from the ON state to the OFF state.

When the cassette 5 is attached to the apparatus main body 201A and the pick holder 4 is turned to a sheet feed position from the retracted position by the retracting mechanism, an abutment state between the abutment portion 4*b* of the pick holder 4 and the holder abutment portion 7*c* of the sheet presence/absence detection flag 7 is released. Since the balance of the weight of the sheet presence/absence detection flag 7 is configured so that the side of the sheet abutment portion 7*a* is heavier, the sheet abutment portion 7*a* of the sheet presence/absence detection flag 7 hangs down, and in contrast, the light-shielding portion 7*b* is lifted, and the sheet sensor 8 is turned into the ON state. More specifically, when the cassette 5 is attached to the apparatus main body 201A, the sheet sensor 8 changes from the OFF state to the ON state.

<Description of Configuration of Control Unit>

Figure 5:
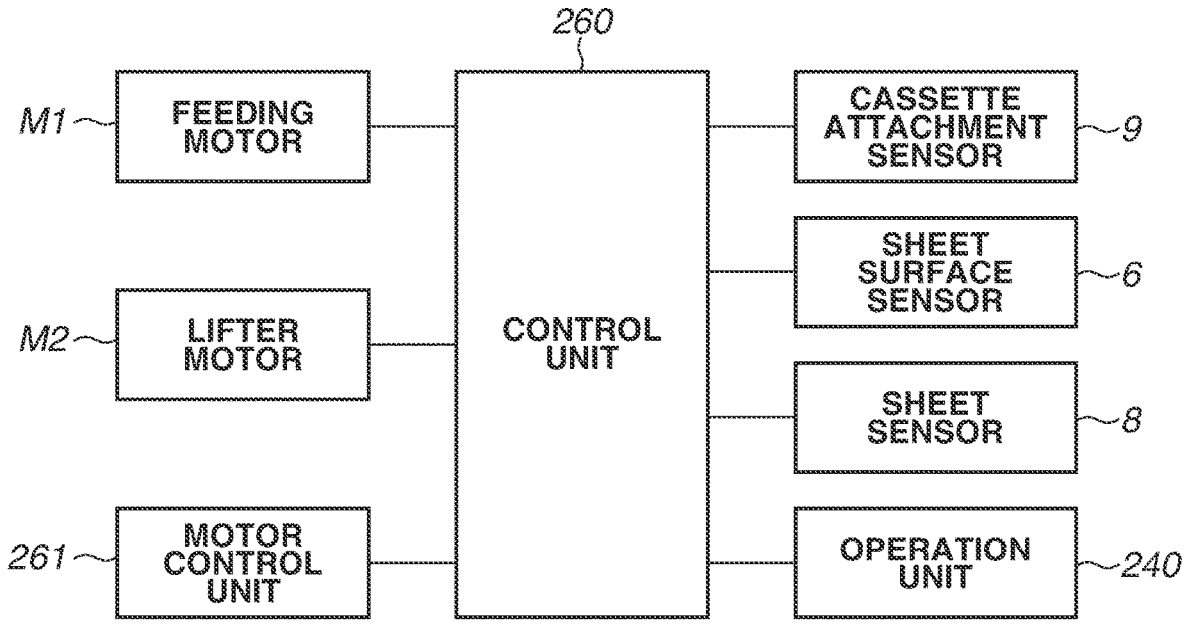
FIG. 5 is a block diagram illustrating control of the feeding device.

A configuration of the control unit 260 will be described with reference to FIG. 5. The control unit 260 is connected to the cassette attachment sensor 9, the sheet surface sensor 6, the sheet sensor 8, an operation unit 240, the feeding motor M1, and the lifter motor M2. The control unit 260 controls driving of the feeding motor M1 and the lifter motor M2 and display of the operation unit 240 based on detection signals output from the sensors. In addition, the control unit 260 determines whether the sheet presence/absence detection flag 7 described below has a failure.

<Description of Operation when Cassette is Attached to Apparatus Main Body>

Figure 2:
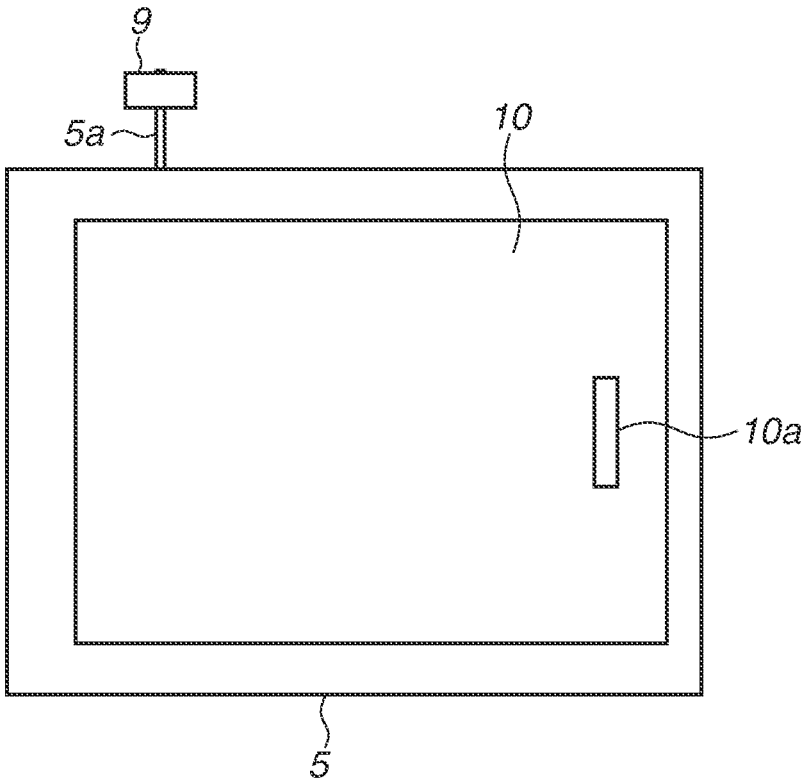
FIG. 2 is a diagram schematically illustrating a configuration of a cassette.

When the cassette 5 is drawn out of the apparatus main body 201A, as illustrated in FIGS. 6A1 and 6A2, the pick holder 4 that holds the pickup roller 1 is turned upward by the retracting mechanism (not illustrated) to retract from the sheet feed position to the retracted position. At this time, the sheet sensor 8 is in the OFF state and the sheet surface sensor 6 is in the ON state.

When the cassette 5 is attached to the apparatus main body 201A, as illustrated in FIGS. 6B1 and 6B2, the retracting mechanism is separated from the pick holder 4 and the pick holder 4 turns toward the intermediate plate 10. More specifically, the pickup roller 1 turns from the retracted position to the sheet feed position. At this time, the sheet sensor 8 is in the ON state and the sheet surface sensor 6 is in the OFF state.

When the cassette 5 is attached to the apparatus main body 201A and the cassette attachment sensor 9 is turned into the ON state, the control unit 260 starts driving of the lifter motor M2, and performs lift-up operation of the intermediate plate 10 until the sheet surface sensor 6 is turned into the ON state. When detecting that the sheet surface sensor 6 is turned into the ON state, the control unit 260 stops the driving of the lifter motor M2 and stops the lift-up operation. In a case where no sheet is stacked (in a case where the sheet is absent) on the intermediate plate 10 after the lift-up operation is stopped, as illustrated in FIGS. 6C1 and 6C2, the sheet presence/absence detection flag 7 falls into the hole 10*a* of the intermediate plate 10, and the sheet sensor 8 is turned into the ON state. On the other hand, in a case where the sheet is stacked on the intermediate plate 10 (in a case where the sheet is present), as illustrated in FIGS. 6D1 and 6D2, the sheet abutment portion 7*a* of the sheet presence/absence detection flag 7 comes in contact with the sheet and the sheet presence/absence detection flag 7 turns. Then, the light-shielding portion 7*b* moves to a position where the sheet sensor 8 is not shielded, and the sheet sensor 8 is turned into the OFF state.

A detection logic of the cassette attachment sensor 9, the sheet surface sensor 6, and the sheet sensor 8 is summarized as in Table 1.

TABLE 1

| State Where Sheet Presence/Absence Detection Flag 7 is Normally Attached | | | |
|---|---|---|---|
| | Cassette Attachment Sensor 9 | Sheet Surface Sensor 6 | Sheet Sensor 8 |
| State Where Cassette 5 is Drawn Out | OFF | ON | OFF |
| Immediately After Cassette 5 is Attached | ON | OFF | ON |
| After Lift-Up is Completed | ON | ON | When sheet is absent: ON, When sheet is present: OFF |

<Description of Operation at Time of Inserting Cassette when Sheet Presence/Absence Detection Flag is Broken>

Incidentally, when the cassette 5 is drawn out of or attached to the apparatus main body 201A, the sheet presence/absence detection flag 7 may be detached or broken due to a collision between the flag and the cassette 5 or the sheets. In the case where the sheet presence/absence detection flag 7 is detached or broken, it may be erroneously detected that a sheet is absent when the sheet is actually present or that a sheet is present when the sheet is actually absent. In the former case, a feeding error occurs when the feeding device tries to start feeding. In the latter case, feeding is not started.

In the present exemplary embodiment, the control unit 260 determines a failure state of the sheet presence/absence detection flag 7 by using the detection logic of the cassette attachment sensor 9, the sheet surface sensor 6, and the sheet sensor 8.

First, a failure of the sheet presence/absence detection flag 7 is classified into the following three cases.

(1) A case where the sheet presence/absence detection flag 7 is detached from the feed frame (2) A case where the sheet presence/absence detection flag 7 is broken and the center of gravity is on the side of the light-shielding portion 7*b* (FIG. 7B)

(3) A case where the sheet presence/absence detection flag 7 is broken and the center of gravity is on the side of the sheet abutment portion 7*a* (FIG. 7A)

<Failure Case of (1)>

In a case where the sheet presence/absence detection flag 7 is normally attached to the feed frame, as described above, the sheet sensor 8 changes from the OFF state to the ON state when the cassette 5 is attached to the apparatus main body 201A.

On the other hand, in the case of (1), since the sheet presence/absence detection flag 7 is detached from the feed frame, the sheet presence/absence detection flag 7 does not shield the sheet sensor 8 from light regardless of whether the cassette 5 is attached. Thus, the light maintains the sheet sensor 8 in the OFF state. More specifically, while a detection signal of the sheet sensor 8 changes in association with the attachment of the cassette 5 when the sheet presence/absence detection flag 7 is normally attached, in the case of (1), the detection signal of the sheet sensor 8 does not change regardless of whether the cassette 5 is attached to the apparatus main body 201A. Thus, when there is no change in the detection signal of the sheet sensor 8 before and after the cassette 5 is attached, it can be determined that a failure occurred to the sheet presence/absence detection flag 7. Thus, in the present exemplary embodiment, the control unit 260 checks whether the sheet sensor 8 has changed from the OFF state to the ON state based on the detection by an attachment detection sensor that the cassette 5 is attached to the apparatus main body 201A. When the sheet sensor 8 does not change to the ON state, it is determined that a failure occurred to the sheet presence/absence detection flag 7, and a message indicating the failure is displayed on the operation unit 240.

<Failure Case of (2)>

Consideration is given to the case of (2) where the sheet presence/absence detection flag 7 is broken and the center of gravity is on the side of the light-shielding portion 7*b*. This case is illustrated in FIG. 7B. In this case, as in the case of (1), the sheet presence/absence detection flag 7 does not shield the sheet sensor 8 from light regardless of whether the cassette 5 is attached to the apparatus main body 201A. Thus, the light maintains the sheet sensor 8 in the OFF state. More specifically, when there is no change in the detection signal of the sheet sensor 8 before and after the cassette 5 is attached to the apparatus main body 201A, it can be determined that a failure has occurred to the sheet presence/absence detection flag 7. Thus, in the present exemplary embodiment, the control unit 260 determines whether the sheet sensor 8 has changed from the OFF state to the ON state based on the detection, by the attachment detection sensor, that the cassette 5 is attached to the apparatus main body 201A. When the sheet sensor 8 does not change to the ON state, it is determined that a failure has occurred to the sheet presence/absence detection flag 7, and a message indicating the failure is displayed on the operation unit 240.

A detection logic of the cassette attachment sensor 9, the sheet surface sensor 6, and the sheet sensor 8 in the cases of (1) and (2) is as illustrated in Table 2.

TABLE 2

Case Where Sheet Presence/Absence Detection Flag 7 is Detached or Broken (Center Of Gravity is on Side of Light-Shielding Portion)

| | Cassette Attachment Sensor 9 | Sheet Surface Sensor 6 | Sheet Sensor 8 |
|---|---|---|---|
| State Where Cassette 5 is Drawn Out | OFF | ON | OFF |
| Immediately After Cassette 5 is Attached | ON | OFF | OFF |
| After Lift-Up is Completed | ON | ON | OFF |

<Failure Case of (3)>

Consideration is given to the case of (3) where the sheet presence/absence detection flag 7 is broken and the center of gravity is on the side of the sheet abutment portion 7*a*. This case is illustrated in FIG. 7A. A detection logic in this case is illustrated in Table 3.

TABLE 3

Case Where Sheet Presence/Absence Detection Flag 7 is Broken (Center of Gravity is on Side of Sheet Abutment Portion)

| | Cassette Attachment Sensor 9 | Sheet Surface Sensor 6 | Sheet Sensor 8 |
|---|---|---|---|
| State Where Cassette 5 is Drawn Out | OFF | ON | OFF |
| Immediately After Cassette 5 is Attached | ON | OFF | ON |
| After Lift-Up is Completed | ON | ON | ON regardless of presence or absence of sheet |

When Table 3 is compared with Table 1, the detection logic in Table 3 is the same as the detection logic when the sheet is absent when the sheet presence/absence detection flag 7 is normally attached in Table 1. Thus, it is difficult to determine the failure of the sheet presence/absence detection flag 7 in the case of (3) only by the detection logic of the sheet sensor 8.

In the present exemplary embodiment, in order to specify the failure case of (3), attention is paid to a required time for lift-up. In this way, the case where the sheet is absent when the sheet presence/absence detection flag 7 is normally attached and the failure case of (3) are distinguished from each other.

Figure 9A:
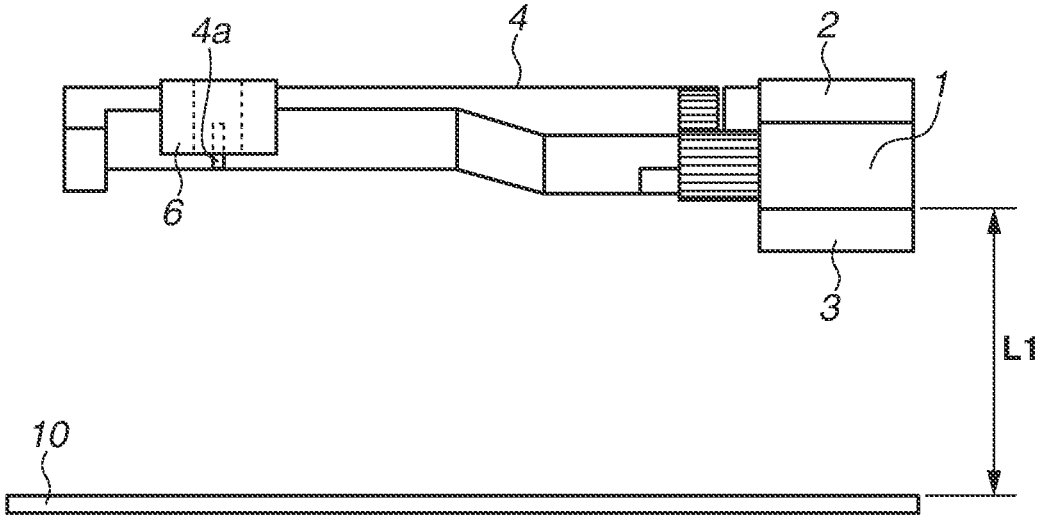
FIGS. 9A and 9B are diagrams illustrating a lift-up distance.

More specifically, in the case where the sheet is absent when the sheet presence/absence detection flag 7 is normally attached, as illustrated in FIG. 9A, the case may be addressed by lifting the intermediate plate 10 by a distance L1 from a position at a bottom of the cassette 5 to a position where the flag portion 4*a* turns ON the sheet surface sensor 6. At this time, if a lift-up speed of the intermediate plate 10 is V, a required time t1 is expressed by t1=L1/V.

Figure 9B:
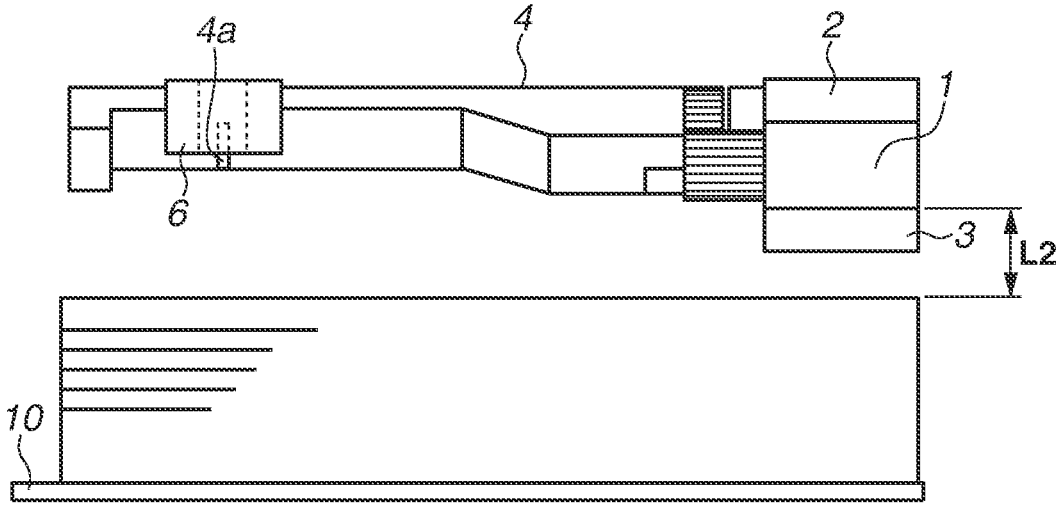

On the other hand, consideration is given to a case where the failure of (3) occurs and the sheets are stacked on the intermediate plate 10. In this case, as illustrated in FIG. 9B, the case may be addressed by lifting the intermediate plate 10 by a distance from the position at the bottom of the cassette 5 to a position where an uppermost sheet contacts the pickup roller 1 and the flag portion 4*a* turns ON the sheet surface sensor 6. If the distance from a height of the uppermost sheet when the intermediate plate 10 is at the bottom of the cassette 5 to a height of the uppermost sheet when the sheet surface sensor 6 is turned ON is L2, a required time t2 is expressed by t2=L2/V.

At this time, since L1 L2 always holds, t1 t2 holds. Thus, a threshold value T is set between the required times t1 and t2, and in a case where the required time for the lift-up is shorter than the threshold value T, if the sheet sensor 8 is ON, it can be determined that a failure has occurred to the sheet presence/absence detection flag 7.

Before the cassette 5 is attached, as illustrated in FIGS. 6A1 and 6A2, the pick holder 4 is retracted by the retracting mechanism (not illustrated). At this time, the sheet sensor 8 is in the OFF state and the sheet surface sensor 6 is in the ON state.

Immediately after the cassette 5 is attached, as illustrated in FIGS. 6B1 and 6B2, the retracting mechanism (not illustrated) is separated from the pick holder 4, and the pick holder 4 falls toward the intermediate plate 10. At this time, the sheet sensor 8 is in the ON state, and the sheet surface sensor 6 is in the OFF state.

Figure 8:
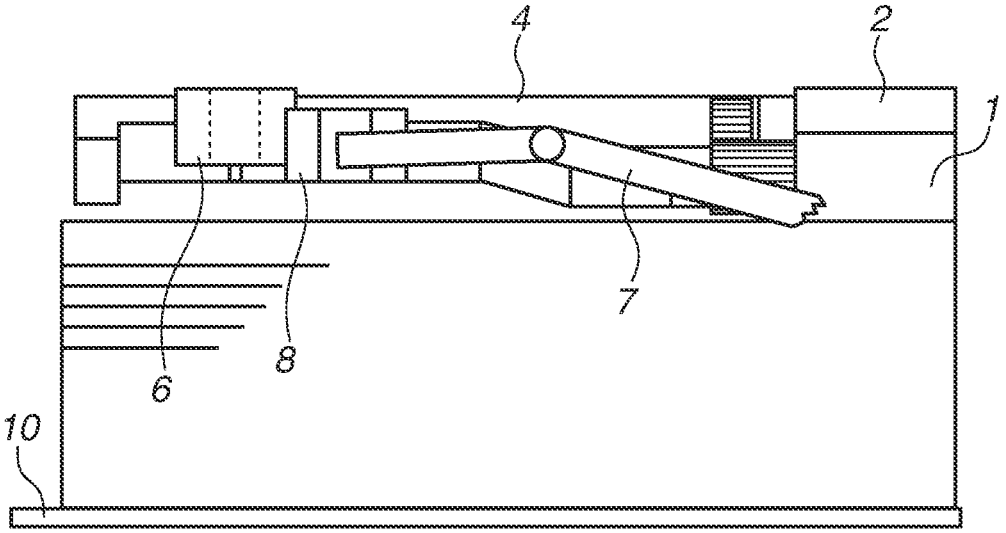
FIG. 8 is a diagram illustrating a position of the sheet presence/absence detection flag when lift-up in a failure mode (3) of the sheet presence/absence detection flag is completed.

When the cassette 5 is attached and the cassette attachment sensor 9 is turned ON, driving of the lifter motor M2 is started, and lift-up operation is performed until the sheet surface sensor 6 is turned ON. In the case where no sheet is stacked on the intermediate plate 10, the sheet presence/absence detection flag 7 falls into the hole 10*a*, and the sheet sensor 8 is turned ON. As illustrated in FIG. 8, in the case where the sheets are stacked on the intermediate plate 10, since a leading end of the sheet presence/absence detection flag 7 on the side of the sheet abutment portion 7*a* is broken, the sheet presence/absence detection flag 7 turns more in a clockwise direction than when the sheet presence/absence detection flag 7 is normally attached. As a result, the sheet sensor 8 is turned ON regardless of an amount of the stacked sheets.

<Description of Failure Detection Flow>

Figure 10:
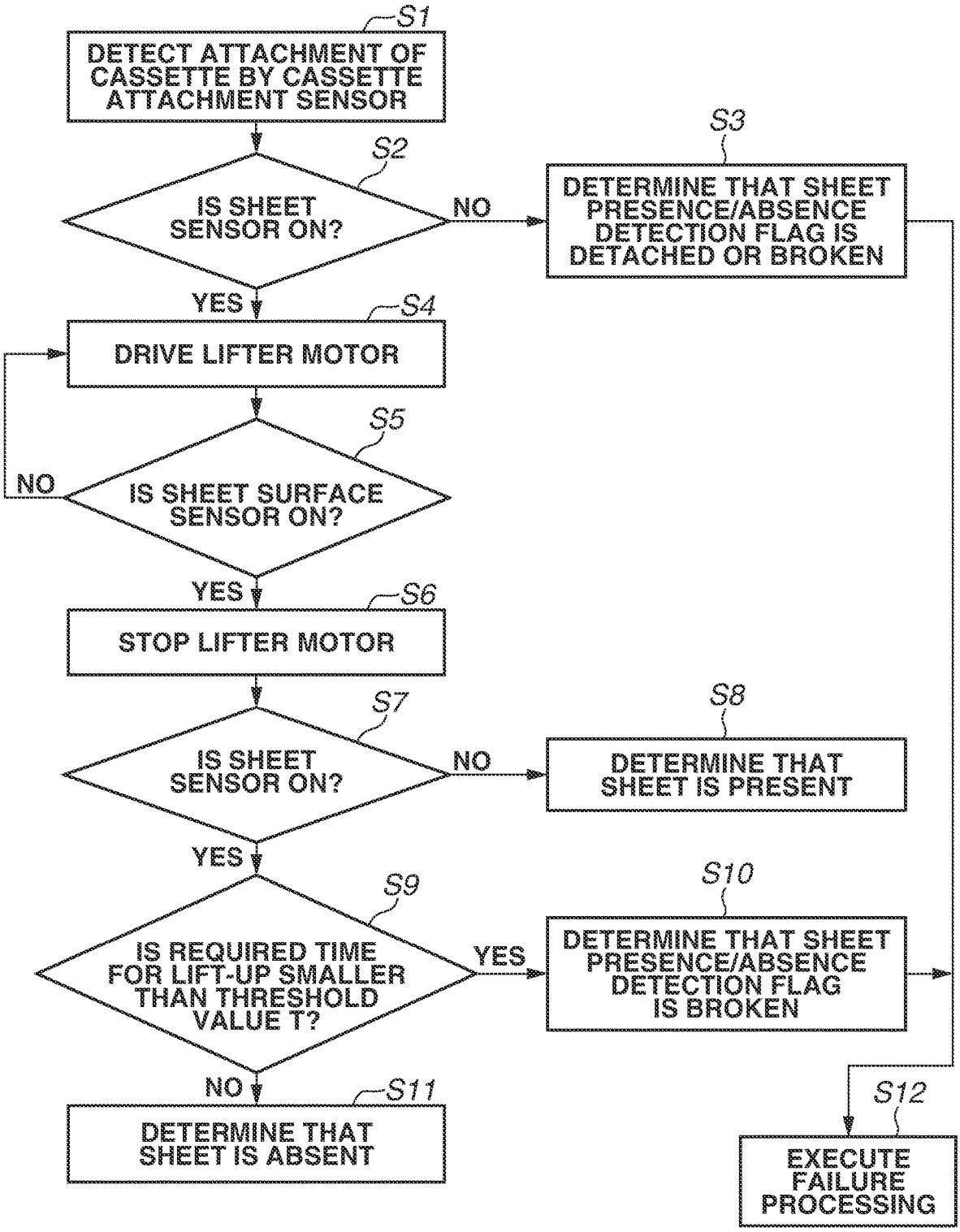
FIG. 10 is a flowchart illustrating processing of determining a failure of the sheet presence/absence detection flag.

A failure detection flow of the sheet presence/absence detection flag 7, which is a feature of the present exemplary embodiment, will be described in detail with reference to a flowchart of FIG. 10.

Figure 11:
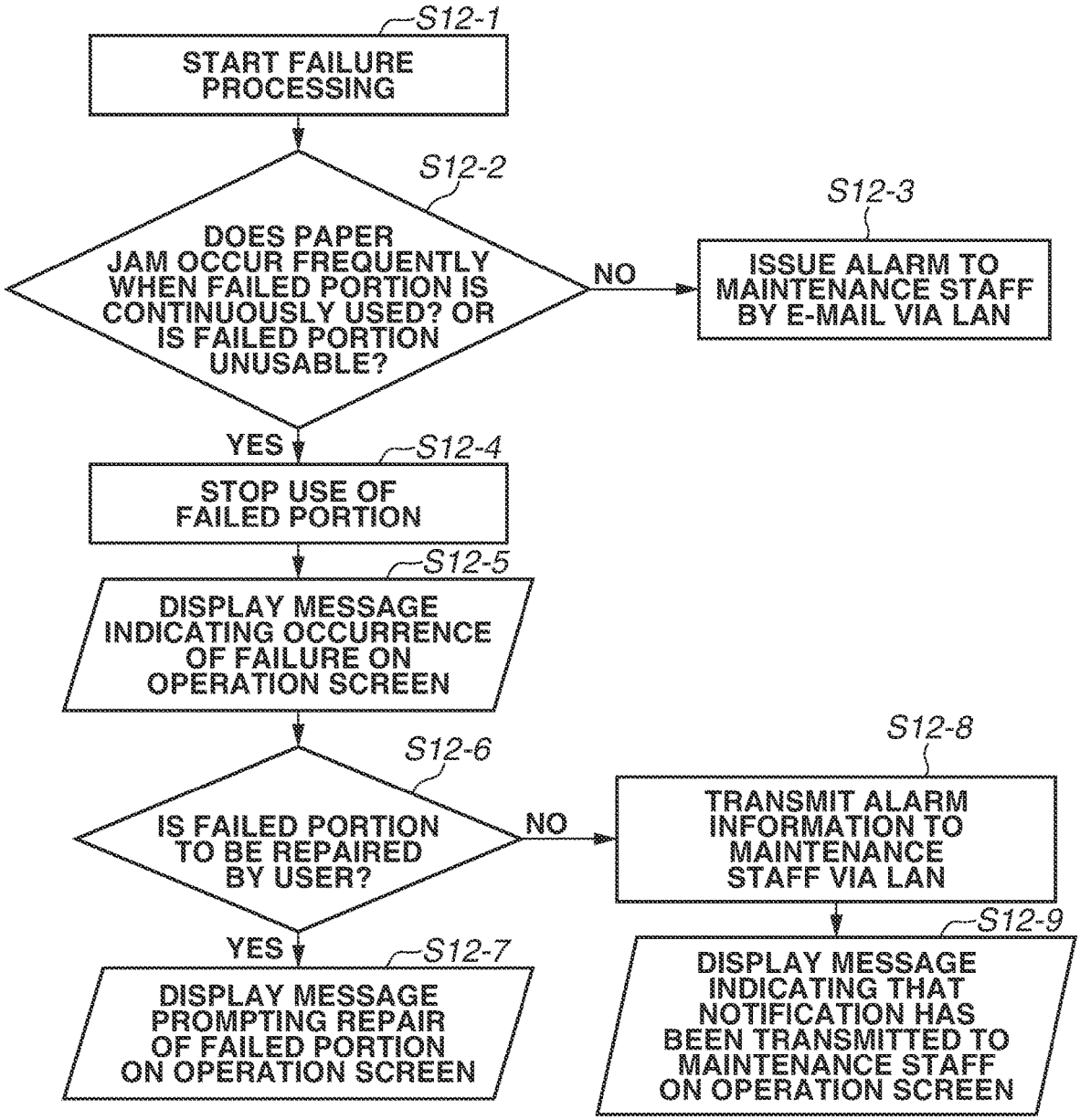
FIG. 11 is a flowchart illustrating failure processing.

In step S1, when the cassette attachment sensor 9 detects the attachment of the cassette 5, in step 2, the control unit 260 checks whether the sheet sensor 8 is in the ON state or the OFF state. In the case where the sheet sensor 8 is in the OFF state (NO in step S2), in step S3, the control unit 260 determines that the sheet presence/absence detection flag 7 is in the failure state of (1) or (2). In the case where the sheet sensor 8 changes to the ON state (YES in step S2), in step S4, the control unit 260 controls driving of the lifter motor M2 and starts the lift-up operation of the intermediate plate 10. In step S5, when the sheet surface sensor 6 is turned ON (YES in step S5), in step S6, the lift-up operation of the intermediate plate 10 is stopped. In step S7, in the case where the sheet sensor 8 is OFF (NO in step S7), in step S8, it is determined that the sheet is present. In the case where the sheet sensor 8 is ON (YES in step S7), the control unit 260 checks a time required from start to end of the lift-up. In step S9, in a case where the required time for the lift-up is smaller than the threshold value T (YES in step S9), in step S10, the control unit 260 determines that the sheet presence/absence detection flag 7 is in the failure state of (3). In a case where the required time for the lift-up is larger than the threshold value T (NO in step S9), in step S11, the control unit 260 determines that there is no sheet (the sheet is absent). In the case where it is determined that the sheet presence/absence detection flag 7 is in the failure state, in step S12, failure processing (processing performed in the event of a failure) illustrated in FIG. 11 is executed.

<Description of Failure Processing Flow>

A processing flow in the case where occurrence of a failure is detected will be described in detail with reference to the flowchart of FIG. 11.

When the occurrence of the failure is detected, in step S12-1, the failure processing is started. In S12-2, in a case where it is acceptable to continuously use a failed portion (NO in step S12-2), in step S12-3, an alarm is issued to a maintenance staff by e-mail or the like via a local area network (LAN). In a case where paper jam frequently occurs when the failed portion is continuously used or in a case where it is difficult to use the failed portion (YES in step S12-2), in step S12-4, use of the failed portion is stopped, and in step S12-5, a message indicating the occurrence of the failure is displayed on the operation screen 20. In a case where the failed portion is to be repaired by the user (YES in step S12-6), in step S12-7, a message prompting repair of the failed portion is displayed on the operation screen 20 of the operation unit 240. In the present exemplary embodiment, a message indicating that the failure of the sheet presence/absence detection flag 7 has occurred and that repair is necessary/appropriate is displayed on the operation unit 240. In a case where the failed portion cannot be repaired by the user (NO in step S12-6), in step S12-8, alarm information is transmitted to the maintenance staff via the LAN, and in step S12-9, a message indicating that a notification has been transmitted to the maintenance staff is displayed on the operation screen 20 of the operation unit 240.

Figure 12:
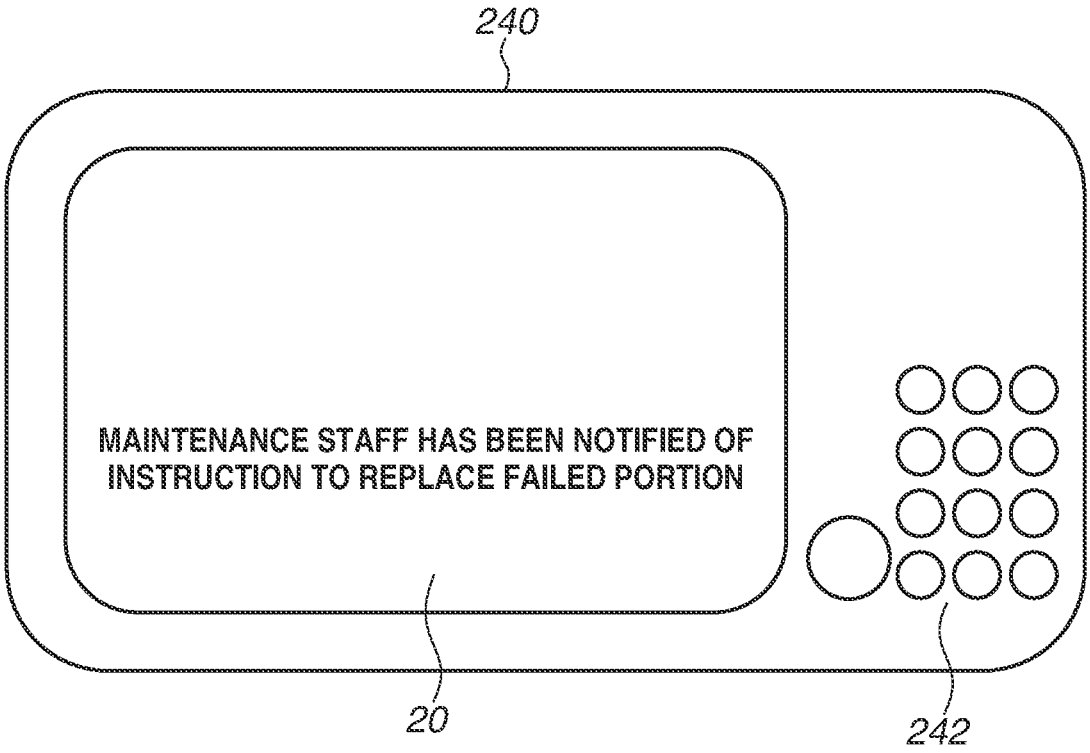
FIG. 12 is a diagram illustrating an example of a screen displayed on an operation unit.

In the case of the failure of the sheet sensor 8 in the present exemplary embodiment, the failure processing is executed if it is determined that use of the image forming apparatus is difficult (YES in step S12-2) and that the failed portion cannot be repaired by the user (NO in step S12-6). As illustrated in FIG. 12, a message for notifying the maintenance staff of the occurrence of the failure and of a replacement instruction is displayed on the operation screen 20 of the operation unit 240.

As described above, according to the present exemplary embodiment, the maintenance staff is notified that the failure of the sheet presence/absence detection flag has been determined, and the use of the image forming apparatus is stopped. As a result, it is possible to prevent erroneous detection in which a sheet is detected to be absent when the sheet is actually present or a sheet is detected to be present when the sheet is actually absent. In addition, since it is possible to notify an operator that a failure has occurred to the sheet presence/absence detection flag, it is possible to eliminate the operator's task of specifying the failed portion.

Note that, in the present exemplary embodiment, the configuration in which the sheet sensor 8 changes from the OFF state to the ON state when the cassette attachment sensor 9 is attached to the apparatus main body 201A has been described as an example. However, the present disclosure is not limited to this example, and the detection logic may be reversed. For example, the sheet sensor 8 may be changed from the ON state to the OFF state when the cassette attachment sensor 9 is attached to the apparatus main body 201A.

In addition, in the present exemplary embodiment, an example has been described in which it is determined that the sheet is absent when the sheet sensor 8 is in the ON state, and that the sheet is present when the sheet sensor 8 is in the OFF state. However, the present disclosure is not limited to this example, and the detection logic may be reversed. Similarly, the detection logic of the sheet surface sensor 6 or the cassette attachment sensor 9 may be reversed.

In addition, in the present exemplary embodiment, an example has been described in which, in the case where it is determined that a failure has been caused to the sheet presence/absence detection flag 7, information indicating that the failure has been caused to the sheet presence/absence detection flag 7 is displayed on the operation unit 240. However, the information may also be transmitted to the server 300 via the LAN while the information is being displayed on the operation unit 240.

In the present exemplary embodiment, an image forming apparatus using an electrophotographic system has been described as an example, but the present disclosure can also be applied to an image forming apparatus using an inkjet system and to a dye sublimation printer.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-121325, filed Jun. 26, 2018, which is hereby incorporated by reference herein in its entirety.

What is claimed is:

1. An image forming apparatus comprising:

a cassette drawably attached to an apparatus main body and configured to store a sheet;

an attachment detection unit configured to detect attachment of the cassette;

a stacking portion provided in the cassette and on which the sheet is to be stacked;

a motor configured to lift the stacking portion;

a feeding roller configured to feed the sheet stacked on the stacking portion;

an image forming unit configured to form an image on the sheet fed by the feeding roller;

a sheet surface detection unit configured to detect that an uppermost sheet stacked on the stacking portion is at a sheet feed position;

a sheet presence/absence detection unit configured to detect presence or absence of the sheet stacked on the stacking portion, wherein the sheet presence/absence detection unit includes a sheet presence/absence detection flag provided in the apparatus main body and is configured to turn in association with the attachment of the cassette; and a control unit configured to drive the motor to start lifting the stacking portion when the attachment of the cassette is detected by the attachment detection unit, to stop lifting the stacking portion in a case where the sheet surface detection unit detects that the uppermost sheet stacked on the stacking portion is at the sheet feed position and, after lifting the stacking portion is stopped, to determine presence or absence of the sheet stored in the cassette based on a detection signal output from the sheet presence/absence detection unit, wherein, in a case where it is determined that there is no change in the detection signal output from the sheet presence/absence detection unit from when the attachment of the cassette is not detected by the attachment detection unit to when the attachment of the cassette is detected by the attachment detection unit, the control unit determines that a failure of the sheet presence/absence detection flag has occurred.

2. The image forming apparatus according to claim 1, further comprising a mechanism configured to turn the feeding roller from the sheet feed position to a retracted position above the sheet feed position when the cassette is drawn out from the apparatus main body, wherein, in a case where the feeding roller is turned from the sheet feed position to the retracted position, a holder configured to hold the feeding roller comes in contact with the sheet presence/absence detection flag and, in response to the contact, the sheet presence/absence detection flag changes a light-shield state of a photosensor in the sheet presence/absence detection unit.

3. The image forming apparatus according to claim 2, wherein the mechanism turns the feeding roller from the retracted position to the sheet feed position when the cassette is attached to the apparatus main body, and wherein, in the case where the feeding roller is turned from the retracted position to the sheet feed position, the holder and the sheet presence/absence detection flag are separated and, in response to the separation, the sheet presence/absence detection flag changes the light-shield state of the photosensor in the sheet presence/absence detection unit.

4. The image forming apparatus according to claim 1, further comprising a display unit configured to display information indicating that a failure has occurred to the sheet presence/absence detection flag.

5. The image forming apparatus according to claim 1, further comprising a transmission unit configured to transmit, to an external apparatus via a network, information indicating that a failure has occurred to the sheet presence/absence detection flag.

6. The image forming apparatus according to claim 1, wherein the control unit stops use of the image forming unit in the case where the control unit determines that a failure has occurred to the sheet presence/absence detection flag.

7. The image forming apparatus according to claim 1, wherein the control unit determines a failure state of the sheet presence/absence detection flag by utilizing detection logic of each of the following: the attachment detection unit, the sheet surface detection unit, and the sheet presence/absence detection unit.

8. The image forming apparatus according to claim 7, wherein one end of the sheet presence/absence detection flag is a sheet abutment portion that abuts on the sheet, and the other end is a light-shielding portion that shields the sheet presence/absence detection unit from light, and wherein, based on the detection logic, the control unit is configured to distinguish between each of the following failure states in determining the failure state of the sheet presence/absence detection flag:

(1) a case where the sheet presence/absence detection flag is detached from an attached state, (2) a case where the sheet presence/absence detection flag is broken and a center of gravity of the sheet presence/absence detection flag is on a side of the light-shielding portion, and (3) a case where the sheet presence/absence detection flag is broken and the center of gravity of the sheet presence/absence detection flag is on a side of the sheet abutment portion.

9. The image forming apparatus according to claim 1, wherein, in a case where it is determined that there is no change in the detection signal output from the sheet presence/absence detection unit from when the cassette is detected as not attached by the attachment detection unit to when the cassette is detected as attached by the attachment detection unit, the control unit determines that a failure to the sheet presence/absence detection flag has occurred.

10. An image forming apparatus comprising:

a cassette drawably attached to an apparatus main body and configured to store a sheet;

an attachment detection unit configured to detect attachment of the cassette;

a stacking portion provided in the cassette and on which the sheet is to be stacked;

a motor configured to lift the stacking portion;

a feeding roller configured to feed the sheet stacked on the stacking portion;

an image forming unit configured to form an image on the sheet fed by the feeding roller;

a sheet surface detection unit configured to detect that an uppermost sheet stacked on the stacking portion is at a sheet feed position;

a sheet presence/absence detection unit configured to detect presence or absence of the sheet stacked on the stacking portion, wherein the sheet presence/absence detection unit includes a sheet presence/absence detection flag provided in the apparatus main body and is configured to turn in association with the attachment of the cassette; and a control unit configured to drive the motor to start lifting the stacking portion when the attachment of the cassette is detected by the attachment detection unit, to stop lifting the stacking portion in a case where the sheet surface detection unit detects that the uppermost sheet stacked on the stacking portion is at the sheet feed position and, after lifting the stacking portion is stopped, to determine that the sheet is absent in a case where a detection signal output from the sheet presence/absence detection unit is a first detection signal, and determine that the sheet is present in a case where the detection signal output from the sheet presence/absence detection unit is a second detection signal, wherein, in a case where the detection signal output from the sheet presence/absence detection unit is the first detection signal and a time from start to end of lifting the stacking portion is shorter than a threshold value, the control unit determines that a failure of the sheet presence/absence detection flag has occurred.

11. The image forming apparatus according to claim 10, further comprising a mechanism configured to turn the feeding roller from the sheet feed position to a retracted position above the sheet feed position when the cassette is drawn out from the apparatus main body, wherein, in a case where the feeding roller is turned from the sheet feed position to the retracted position, a holder configured to hold the feeding roller comes in contact with the sheet presence/absence detection flag and, in response to the contact, the sheet presence/absence detection flag changes a light-shield state of a photosensor in the sheet presence/absence detection unit.

12. The image forming apparatus according to claim 11, wherein the mechanism turns the feeding roller from the retracted position to the sheet feed position when the cassette is attached to the apparatus main body, and wherein, in the case where the feeding roller is turned from the retracted position to the sheet feed position, the holder and the sheet presence/absence detection flag are separated and, in response to the separation, the sheet presence/absence detection flag changes the light-shield state of the photosensor in the sheet presence/absence detection unit.

13. The image forming apparatus according to claim 10, further comprising a display unit configured to display information indicating that a failure has occurred to the sheet presence/absence detection flag.

14. The image forming apparatus according to claim 10, further comprising a transmission unit configured to transmit, to an external apparatus via a network, information indicating that a failure has occurred to the sheet presence/absence detection flag.

15. The image forming apparatus according to claim 10, wherein the control unit stops use of the image forming unit in the case where the control unit determines that a failure has occurred to the sheet presence/absence detection flag.

* * * * *